US005653483A

United States Patent [19]

Grover

[11] Patent Number: 5,653,483

[45] Date of Patent: Aug. 5, 1997

[54] SLIDING DOOR LATCH

[76] Inventor: Philip D. Grover, 4999 Morrow Rd., Modesto, Calif. 95356

[21] Appl. No.: 508,475

[22] Filed: Jul. 28, 1995

Related U.S. Application Data

[63] Continuation-in-part of Ser. No. 134,951, Sep. 29, 1993, abandoned .

[51] Int. Cl.[6] ..... E05C 3/02

[52] U.S. Cl. ..... 292/194; 70/DIG. 52; 292/336; 292/DIG. 46; 292/196; 292/223

[58] Field of Search ..... 70/DIG. 52, 100, 70/99; 292/336, 334, DIG. 2, DIG. 46, 123, 126, 223, 226, 196

[56] References Cited

U.S. PATENT DOCUMENTS

| | | | |
|---|---|---|---|
| 1,850,516 | 3/1932 | Ross | 292/DIG. 61 |
| 2,087,143 | 7/1937 | Geske et al. | 70/DIG. 52 |
| 2,138,251 | 11/1938 | Lindstrom et al. | 70/DIG. 52 |
| 3,625,557 | 12/1971 | Jensen | 70/DIG. 52 |
| 3,884,056 | 5/1975 | East et al. | 70/DIG. 52 |

*Primary Examiner*—Darnell M. Boucher
*Attorney, Agent, or Firm*—Robert M. Sperry

[57] ABSTRACT

An improved sliding door latch comprising a recess formed in the leading edge of a sliding door, a latchplate covering said recess and formed with an opening to allow engagement by a latch member, a housing mountable in a recess formed in a door jamb, a latch member pivotally mounted in said housing and movable into and out of a position engaging said latchplate, lever means actuable to move said latch member, and privacy latch engageable with said lever means to prevent undesired actuation of said lever means.

10 Claims, 4 Drawing Sheets

SLIDING DOOR LATCH

RELATED CASES

This application is a Continuation-In-Part of my prior patent application Ser. No. 08/134,951, filed Sep. 29, 1993 and now abandoned.

BACKGROUND

1. Field of Invention

This invention relates to door latches and is particularly directed to improved door latches for sliding or pocket doors and the like, together with means for facilitating the use of such doors by handicapped persons.

2. Prior Art

There is a definite need in the domestic or home market for a positive locking latch for sliding or pocket doors. Latches which are currently available are either too light in construction and, hence, provide inadequate security, or are too heavy in construction, being intended for fire doors and requiring a key to lock or unlock them. Furthermore, installation of most prior art door latches requires that a large notch be cut from the leading edge of the door in which to mount the latch mechanism. However, this severely weakens the front stile of many hollow core doors, making them very weak and vulnerable to splitting. Also, most prior art sliding door latches are constructed to keep the door from sliding open accidentally, but do not incorporate a privacy latch. Consequently, even when latched, the doors can often be opened by lifting and sliding the door and many such latches will disengage when pressure is applied to them. This can cause much embarrassment when the door is used for a bathroom or bedroom. Still other prior art sliding door latches have been difficult or impossible for handicapped persons to actuate. A search in the United States Patent Office has revealed the following:

| U.S. PAT. NO. | INVENTOR | ISSUED |
|---|---|---|
| 4,607,510 | G. Shanaan et al | Aug. 26, 1986 |
| 4,663,949 | B. Yane | May 12, 1987 |
| 4,932,694 | L. Cater, Sr. | Jun. 12, 1990 |
| 5,174,617 | M. G. Huber et al | Dec. 29, 1992 |

Each of these references is subject to the disadvantages discussed above. Thus, none of the prior art sliding door latches have been entirely satisfactory.

BRIEF SUMMARY AND OBJECTS OF INVENTION

These disadvantages of the prior art are overcome with the present invention and an improved sliding door latch is provided which can be installed without damaging the structural integrity of the door and which is inexpensive to purchase and simple to install, yet which provides positive protection against unauthorized entry, together with a privacy latch to provide greater protection against intrusion and which is readily actuable by handicapped persons.

These advantages of the present invention are preferably attained by providing an improved sliding door latch comprising a recess formed in the leading edge of a sliding door, a latchplate covering said recess and formed with an opening to allow engagement by a latch member, a housing mountable in a recess formed in a door jamb, a latch member pivotally mounted in said housing and movable into and out of a position engaging said latchplate, lever means actuable to move said latch member, and privacy latch engageable with said lever means to prevent undesired actuation of said lever means.

Accordingly, it is an object of the present invention to provide an improved sliding door latch.

Another object of the present invention is to provide an improved sliding door latch which can be installed without damaging the structural integrity of the door.

An additional object of the present invention is to provide an improved sliding door latch which is inexpensive to purchase and simple to install.

A further object of the present invention is to provide an improved sliding door latch which provides positive protection against unauthorized entry.

Another object of the present invention is to provide an improved sliding door latch having a privacy latch to provide greater protection against intrusion.

An additional object of the present invention is to provide an improved sliding door latch which is readily actuable by handicapped persons.

A specific object of the present invention is to provide an improved sliding door latch comprising a recess formed in the leading edge of a sliding door, a latchplate covering said recess and formed with an opening to allow engagement by a latch member, a housing mountable in a recess formed in a door jamb, a latch member pivotally mounted in said housing and movable into and out of a position engaging said latchplate, lever means actuable to move said latch member, and privacy latch engageable with said lever means to prevent undesired actuation of said lever means.

These and other objects and features of the present invention will be apparent from the following detailed description, taken with reference to the figures of the accompanying drawing.

DETAILED DESCRIPTION OF THE INVENTION

Figure 1:
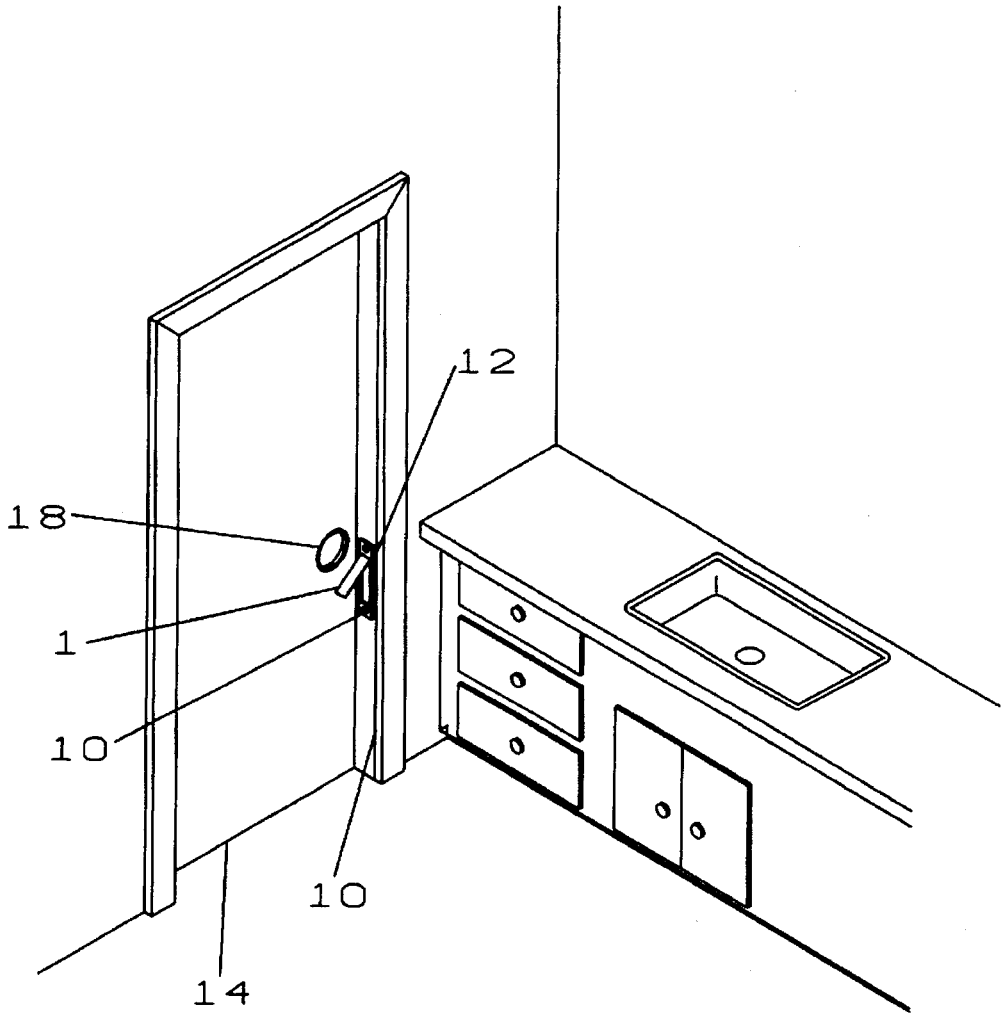
FIG. 1 is an isometric view of a sliding door having a latch embodying the present invention.
Figure 2:
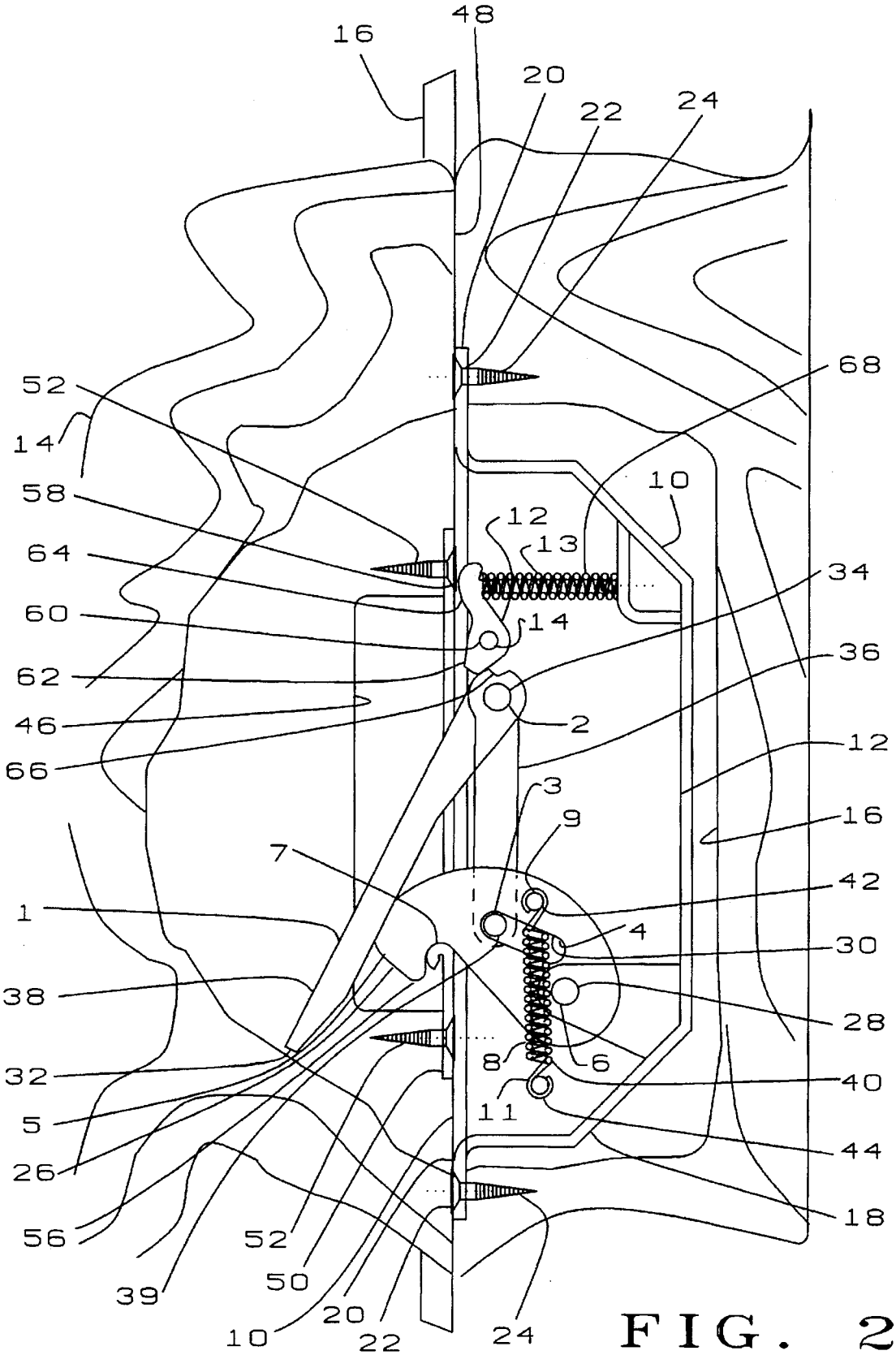
FIG. 2 is a vertical section through the door jamb and leading edge of the door of FIG. 1, showing the sliding door latch of the present invention in the latched position.
Figure 3:
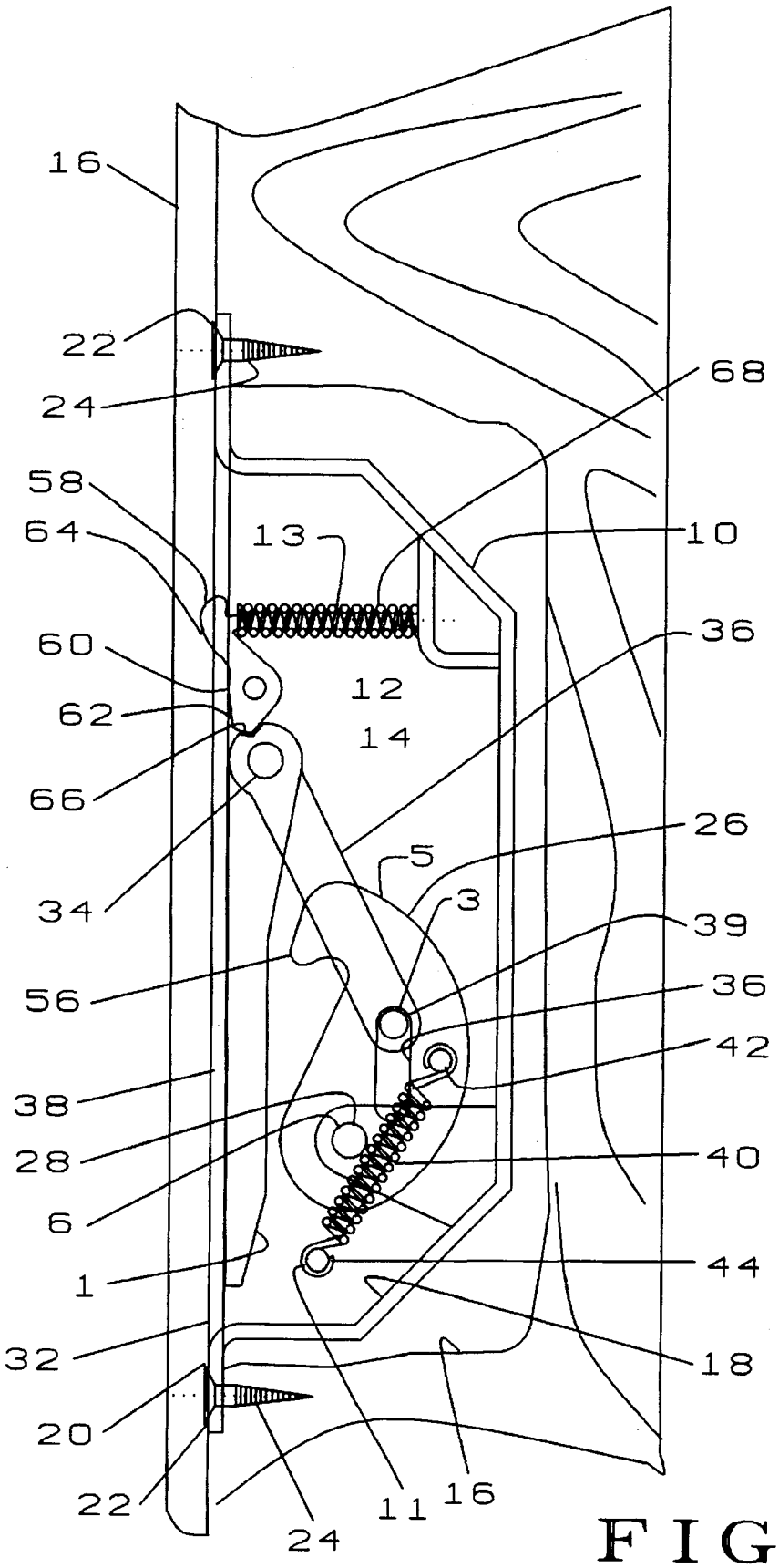
FIG. 3 is a view, similar to that of FIG. 2, showing the sliding door latch of the present invention in the unlatched position.

In that form of the present invention chosen for purposes of illustration in the drawing, FIG. 1 shows a door frame 10 having a latch, indicated generally at 12, mounted in the frame 10 for releasably securing a sliding door 14. As best seen in FIG. 2, the frame 10 is provided with a recess 16 to house the latch 12. The latch 12 comprises a generally box-like housing 18 having a front cover 20 formed with openings 22 for receiving suitable attaching means, such as screws 24 for releasably securing the housing 18 to the door frame 10. Within the housing 18, a latch member 26 is pivotally mounted on a pin 28 and is formed with an elongated slot 30. A generally V-shaped actuating member 32 is pivotally mounted by pin 34 and has a first arm 36 carrying a stud 38 which projects into the slot 30 of the latch member 26 and is slideable within the slot 30 to cause the latch member 26 to pivot about pin 28 between a "locked" position, as seen in FIG. 2 and an "unlocked" position, as seen in FIG. 3. The actuating member 36 has a second arm 32 which is operable by the user to pivot the actuating member 36 about pin 34 and, hence, to cause stud 39 to move the latch member 26 into or out of the locking position. The slot 30 is of sufficient length to allow stud 39 to move past the center-line joining pins 28 and 34 in moving between the "unlocked" position of FIG. 3 and the "locked" position of FIG. 2, which serves to prevent inadvertent movement of the latch member 26. Moreover, resilient means, such as spring 40, is provided extending between a pin 42 carried by the latch member 26 and stud 44, which projects from the housing 18, to further prevent undesired movement of the latch member 26. As best seen in FIG. 2, the sliding door 14 has a recess 46 formed in the leading edge 48 of the door 14 and a cover plate 50 is secured to the leading edge 48 of the door 46 by suitable means, such as screws 52. As best seen in FIG. 3, the cover plate 50 is formed with an opening 54 which allows the tip 56 of the latch member 26 to enter the recess 46 of the sliding door 14, as seen in FIG. 2, and to engage the cover plate 50 to "lock" the sliding door 14 to the door frame 10. When the latch member 26 is moved to the "unlocked" position of FIG. 3, the tip 56 of the latch member 26 swings out of the recess 46 of the sliding door 14 to allow free movement of the door 14. As a safety precaution, lever 58 may be pivotally mounted on pin 60 and has a short leg 62 and a longer leg 64. The short leg 62 is movable into and out of a depression 66 formed in the actuator member 36. When the sliding door 14 is open, the longer leg 64 of lever 58 is urged outwardly by spring 68, which causes the short leg 62 of lever 58 to enter the depression 66 of the actuator member 36 and serves to prevent inadvertent operation of the actuator member 32. Operation of the actuator member 32 would move latch member 26 to the "locked" position of FIG. 1, when the sliding door 14 is still open, and would place tip 56 of the latch member 26 in a position to butt against the cover plate 50 to prevent closing of the sliding door 14. However, when the sliding door 14 is closed, the leading edge 48 of the sliding door 14 will force leg 64 of lever 58 inwardly, against the action of spring 68, which will move the short leg 62 of lever 58 out of depression 66 and will allow operation of the actuator member 32.

In use, the latch 12 will initially be in the "unlocked" position, as seen in FIG. 3, and the sliding door 14 will be open. when someone desires privacy, they will pull the sliding door 14 closed, causing the leading edge 48 of the sliding door 14 to abut the door frame 10. In doing this, the leading edge 48 of the sliding door 14 will press the long leg 64 of lever 58 inwardly, against the action of spring 68, which will cause lever 58 to pivot about pin 60 and will cause the short leg 62 of lever 58 to disengage from the depression 66 of actuator member 36 and, hence, to release actuator member 32 for operation. To operate actuator member 32, the user pulls outward on arm 32 of the actuator member 32, causing the actuator member 32 to pivot about pin 34 and causing arm 36 of the actuator member 32 to swing stud 39 forwardly. Since stud 39 projects into slot 30 of the latch member 26, forward movement of stud 39 will serve to pivot the latch member 26 about pin 28 to the "locked" position, shown in FIG. 2. As this happened, the tip 56 of the latch member 26 will be swung forward to enter the recess 46 of the sliding door 14 and to lockingly engage the cover plate 50 of the sliding door 14. In this position, stud 39 has moved past the centerline between pins 34 and 28 and, consequently, is "over center", which prevents inadvertent movement of the latch member 26. Furthermore, spring 40 serves to urge the latch member 26 to remain in the "locked" position and provide further protection against undesired movement of the latch member 26. Thus, the sliding door 14 is securely locked and, since the actuator lever 32 is located on the inside of sliding door 14, that is, the side whose privacy is to be protected, the sliding door 14 cannot be opened from the outside. When the person inside wishes to open the sliding door 14, they press arm 32 of the actuator member 36 inward. This causes the actuator member 36 to pivot about pin 34 and causes the actuator member 36 to swing stud 39 rearwardly, which causes latch member 26 to pivot about pin 28 to return to the "unlocked" position, seen in FIG. 3, whereupon, the sliding door 14 may be slid open. If necessary or desirable, a hole, not shown, could be drilled through the door frame 10, in alignment with pin 28 and a screwdriver-type tool could be provided which would be insertable through the hole to rotate pin 28 and the latch member 26 to permit opening of the sliding door 14 from the outside for safety purposes or to enable parents to release a child who has accidentally or deliberately locked themselves in.

Figure 4:
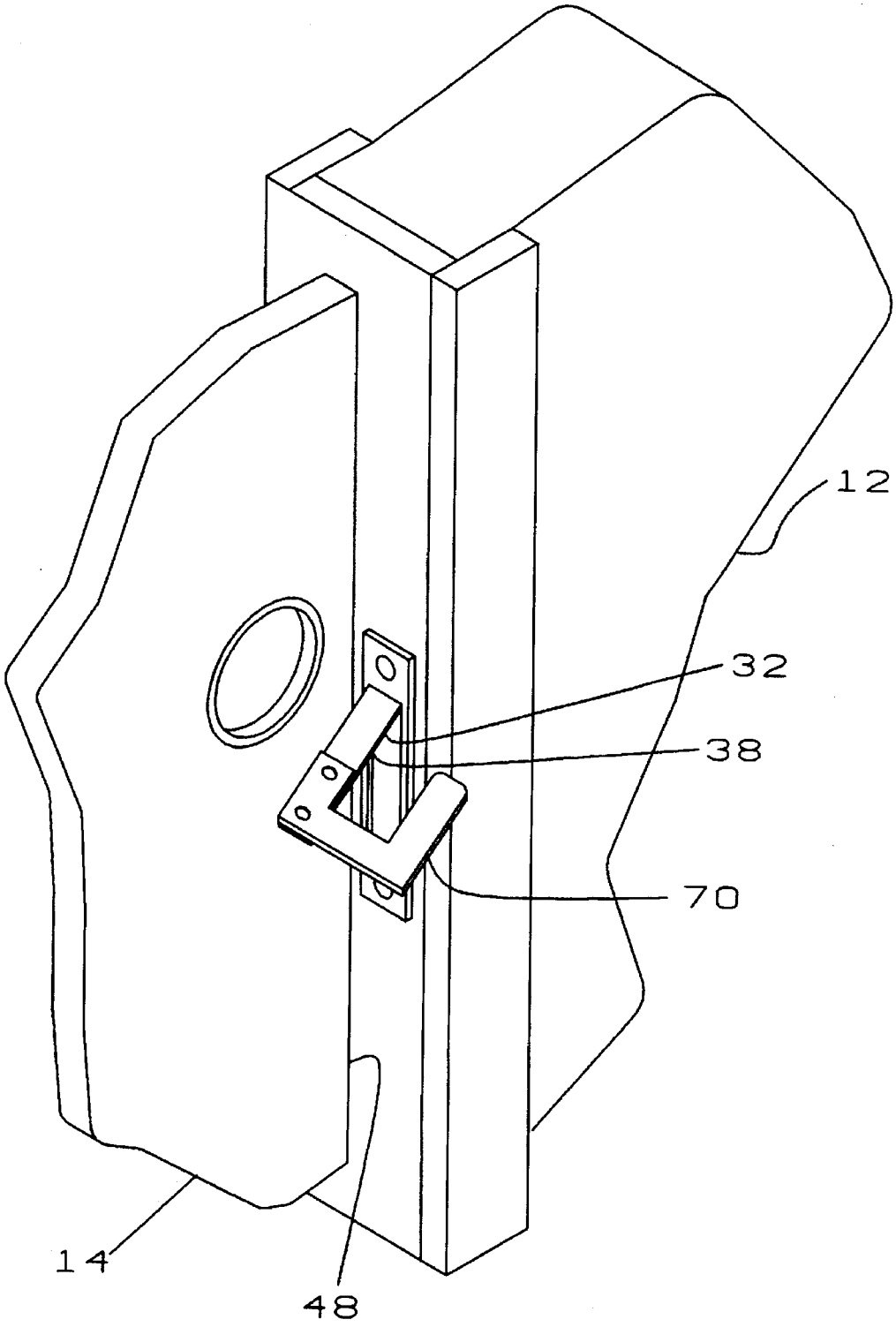
FIG. 4 is an isometric view showing the sliding door latch of FIG. 1 with an extension for facilitating actuation by handicapped persons.

FIG. 4 shows the latch 12 with a generally U-shaped extension 70 attached to arm 32 of the actuator member 36. It is found that this U-shaped extension 70 greatly facilitates operation of the actuator member 32 by handicapped persons.

Obviously, numerous other variations and modifications also can be made without departing from the spirit oft he present invention. therefore, it should be clearly understood that the forms of the present invention described above and shown in the figures of the accompanying drawing are illustrative only and are not intended to limit the scope of the present invention.

What is claimed is:

1. An improved sliding door latch comprising:

a sliding door having a leading edge with a recess formed therein, a latchplate covering said recess and formed with an opening allowing access to said recess, a door jamb having a recess formed therein, a housing mounted in said door jamb recess, a latch member pivotally mounted in said housing and movable between a latched position projecting into said leading edge recess and an unlatched position into which said latch member is fully retracted within said door jamb recess, lever means actuable to move said latch member, and a single spring urging said latch member to remain in each of its latched and unlatched positions.

2. The device of claim 1 wherein:

said lever means is a generally V-shaped member which is pivotally mounted within said housing and has an arm connected to move said latch member.

3. The device of claim 2 wherein:

said latch member is formed with an elongated slot and said arm carries a stud projecting into said slot to move said latch member.

4. The device of claim 3 wherein:

said stud is movable within the slot of said latch member across a line joining the pivot points of said lever and said latch member.

5. The device of claim 1 further comprising:

resilient means urging said latch member to remain in either its locked or unlocked position.

6. The device of claim 1 further comprising;

a privacy latch engageable with said lever means to prevent undesired actuation of said lever means.

7. The device of claim 6 wherein:

said privacy latch is a lever pivotally mounted in said housing and having a first leg and a second leg, said first leg being actuable by the leading edge of said door to pivot said privacy latch and said second leg being engageable with said lever means to prevent inadvertent actuation of said lever member.

8. The device of claim 7 wherein:

said lever member has a depression formed therein and said second leg of said privacy latch is movable into said depression to prevent operation of said lever member and is movable out of said depression to permit operation of said lever member.

9. The device of claim 1 further comprising:

a generally U-shaped extension attached to said lever means to facilitate actuation of said lever means by handicapped persons.

10. An improved sliding door latch comprising:

a sliding door having a leading edge with a recess formed therein, a latchplate covering said recess and formed with an opening allowing access to said recess, a door jamb having a recess formed therein, a housing mounted in said door jamb recess, a latch member pivotally mounted in said housing and movable between a latched and an unlatched position, lever means actuable to move said latch member, means urging said latch member to remain in each of its latched and unlatched position, a privacy latch engageable with said lever means to prevent undesired actuation of said lever means, said privacy latch is a lever pivotally mounted in said housing and having a first leg and a second leg, said first leg being actuable by the leading edge of said door to pivot said privacy latch and said second leg being engageable with said lever means to prevent inadvertent actuation of said lever member.

* * * * *